US009377164B2

(12) United States Patent
Utal et al.

(10) Patent No.: US 9,377,164 B2
(45) Date of Patent: Jun. 28, 2016

(54) MODULAR COMPRESSED NATURAL GAS SYSTEM

(71) Applicant: General Electric Company, Schenectady, NY (US)

(72) Inventors: Dalbir Singh Utal, Houston, TX (US); Ryan McReynolds, Houston, TX (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 13/645,109

(22) Filed: Oct. 4, 2012

(65) Prior Publication Data

US 2013/0232916 A1 Sep. 12, 2013

Related U.S. Application Data

(60) Provisional application No. 61/607,506, filed on Mar. 6, 2012.

(51) Int. Cl.
*F17C 5/06* (2006.01)
*F17D 1/04* (2006.01)
(Continued)

(52) U.S. Cl.
CPC . *F17D 1/04* (2013.01); *F17C 5/007* (2013.01); *F17C 5/06* (2013.01); *F17C 13/083* (2013.01); *F17C 13/123* (2013.01); *F17C 2205/0111* (2013.01); *F17C 2205/0157* (2013.01); *F17C 2205/0176* (2013.01); *F17C 2221/032* (2013.01);
(Continued)

(58) Field of Classification Search
CPC ..... F17C 5/002; F17C 5/005; F17C 5/007; F17C 5/02; F17C 5/04; F17C 5/06; F17C 5/00; F02B 63/044; Y10T 137/0318; Y10T 137/6851
USPC ..... 141/21, 25, 26, 37, 69, 83, 85, 89, 231, 141/237; 52/79.1
See application file for complete search history.

(56) References Cited

U.S. PATENT DOCUMENTS 4,004,430 A * 1/1977 Solomon et al. ..... 62/621
4,136,432 A * 1/1979 Melley, Jr. ..... 29/469
(Continued)

FOREIGN PATENT DOCUMENTS

CN 10430296 1/2015
DE 227858 A3 9/1985
(Continued)

OTHER PUBLICATIONS

PCT Search Report and Written Opinion issued Apr. 29, 2014 in connection with corresponding PCT Patent Application No. PCT/US2013/029277.
(Continued)

*Primary Examiner* — Mark A Laurenzi
*Assistant Examiner* — Andrew StClair
(74) *Attorney, Agent, or Firm* — Bracewell LLP

(57) ABSTRACT

A compression system is disposed in a container and shipped to a location having a supply of natural gas. The compression system connects to the natural gas supply, compresses gas from the supply, and provides compressed gas to a consumer. The container, which can be a standardized ISO shipping container, is fitted with removable vents at designated locations. Strategic positioning of compression system components in combination with the removable vents allows for ready access to the compression system for repair and maintenance.

21 Claims, 12 Drawing Sheets

(51) Int. Cl.
*F17C 5/00* (2006.01)
*F17C 13/08* (2006.01)
*F17C 13/12* (2006.01)

(52) U.S. Cl.
CPC ..... *F17C 2221/033* (2013.01); *F17C 2221/035* (2013.01); *F17C 2223/0123* (2013.01); *F17C 2223/033* (2013.01); *F17C 2225/0123* (2013.01); *F17C 2225/036* (2013.01); *F17C 2227/0164* (2013.01); *F17C 2227/0346* (2013.01); *F17C 2227/0388* (2013.01); *F17C 2250/01* (2013.01); *F17C 2250/032* (2013.01); *F17C 2250/034* (2013.01); *F17C 2250/043* (2013.01); *F17C 2250/046* (2013.01); *F17C 2250/0439* (2013.01); *F17C 2250/0636* (2013.01); *F17C 2260/015* (2013.01); *F17C 2265/012* (2013.01); *F17C 2265/015* (2013.01); *F17C 2265/065* (2013.01); *F17C 2265/068* (2013.01); *F17C 2270/0105* (2013.01); *F17C 2270/0139* (2013.01); *F17C 2270/0168* (2013.01); *F17C 2270/0171* (2013.01); *F17C 2270/0176* (2013.01); *F17C 2270/0178* (2013.01); *Y10T 137/0318* (2015.04); *Y10T 137/6851* (2015.04)

(56) References Cited

U.S. PATENT DOCUMENTS 4,272,967 A * 6/1981 White et al. ..... 62/236
4,522,159 A 6/1985 Engel et al.
4,531,558 A * 7/1985 Engel et al. ..... 141/44
4,986,446 A * 1/1991 Montgomery ..... B60S 5/02 137/234.6
5,350,442 A * 9/1994 Thelen et al. ..... 95/115
5,847,537 A * 12/1998 Parmley, Sr. ..... 320/109
5,954,099 A * 9/1999 Princiotta et al. ..... 141/18
6,230,939 B1 * 5/2001 Willeke ..... B60S 5/02 137/234.6
D455,442 S 4/2002 Call et al.
6,412,588 B1 * 7/2002 Scott ..... B60K 15/013 137/267
6,644,247 B2 * 11/2003 Campion ..... 123/2
6,732,769 B2 * 5/2004 Del Campo ..... 141/97
6,755,225 B1 * 6/2004 Niedwiecki et al. ..... 141/231
6,901,302 B2 * 5/2005 Kami ..... 700/90
7,007,966 B2 * 3/2006 Campion ..... 280/423.1
7,059,364 B2 * 6/2006 Kountz et al. ..... 141/4
7,081,682 B2 * 7/2006 Campion ..... 290/1 A
D550,716 S 9/2007 Bennett
D550,721 S 9/2007 Tanaka et al.
7,415,995 B2 * 8/2008 Plummer et al. ..... 141/197
7,619,319 B1 * 11/2009 Hunter ..... 290/4 R
D613,767 S 4/2010 Latsos
D622,737 S 8/2010 Nagai et al.
D630,652 S 1/2011 Yoshioka
7,976,067 B2 * 7/2011 Naganuma ..... B60H 1/00371 180/69.2
8,235,009 B2 * 8/2012 Hunter ..... 123/3
8,294,285 B2 * 10/2012 Hunter ..... 290/1 R
8,302,997 B2 * 11/2012 Veenstra ..... B60K 15/07 137/267
8,495,869 B2 * 7/2013 Beissler et al. ..... 60/301
8,620,486 B2 * 12/2013 Cheng ..... 700/299
2003/0029390 A1 * 2/2003 Campion ..... 123/2
2004/0265198 A1 * 12/2004 Biswas et al. ..... 423/210
2006/0070682 A1 4/2006 Melvin et al.
2006/0086406 A1 * 4/2006 Sato et al. ..... 141/94
2006/0118575 A1 6/2006 Boyd et al.
2006/0185262 A1 * 8/2006 Abler ..... 52/64
2006/0213370 A1 * 9/2006 Leonard et al. ..... 96/243
2010/0060016 A1 * 3/2010 Hunter ..... 290/1 R
2013/0312870 A1 * 11/2013 Evans et al. ..... 141/69
2013/0314037 A1 * 11/2013 Caffy ..... 320/109

FOREIGN PATENT DOCUMENTS

DE 10242159 A1 3/2004
GB 2469084 A 10/2010
WO 2004111525 A1 12/2004
WO 2010038069 A2 4/2010

OTHER PUBLICATIONS

Invitation to pay Additional Fees from corresponding PCT Application No. PCT/US2013/029277 dated Jun. 7, 2013.

US Notice of Allowance issued in connection with corresponding U.S. Appl. No. 29/431,481 on Dec. 12, 2012.

* cited by examiner

MODULAR COMPRESSED NATURAL GAS SYSTEM

RELATED APPLICATIONS

This application claims priority to and the benefit of co-pending U.S. Provisional Application Ser. No. 61/607,506, filed Mar. 6, 2012, the full disclosure of which is hereby incorporated by reference herein.

BACKGROUND

1. Field of Invention

The present disclosure relates in general to a system and method for compressing gas. More specifically, the present disclosure relates to a modular system that is transportable to a location where gas is accessible from a source, and that compresses gas from the source.

2. Description of Prior Art

Traditionally, internal combustion engines have been fueled by one or more distillates of fuel oil, such as gasoline or diesel. Gasoline or diesel is at atmospheric pressure during filling. Recently a growing number of vehicles have been manufactured, or converted, so their engines operate on natural gas instead of the longer chain hydrocarbons. The availability, low cost, and lower emissions of combusting natural gas over fuel oil distillates have garnered interest in continuing to increase the number of natural gas powered vehicles. Typically, natural gas fills a vehicle at a pressure exceeding 3000 pounds per square inch, which greatly exceeds the atmospheric pressure conditions of traditional fuels. The high filling pressure of natural gas requires compressing the natural gas prior to dispensing it to the vehicle. Thus while there are incentives to power vehicles with natural gas, obstacles exist in its delivery.

SUMMARY OF THE INVENTION

Disclosed herein is a method of supplying compressed gas. In an example the method of supplying compressed gas includes providing a standardized shipping container and disposing a compressor package in the container to define a modular compression system. The modular compression system is transported to a location having a supply of hydrocarbon gas, and hydrocarbon gas from the supply is compressed to form compressed gas. The compressed gas is then delivered to a dispenser accessible by a consumer of the compressed gas. In an example, the compressor package is made up of a compressor, a driver, piping, and valves in the piping; which are strategically oriented and located in the shipping container. Strategically orienting the elements of the compressor package makes the locations of maintenance of the compressor, driver, piping, and valves accessible through selectively opened access elements in sidewalls of the shipping container. In this example, the access elements are vents that are selectively removable from the shipping container. In an alternative, the compressor package includes a fan cooler disposed in the shipping container and that is in fluid communication with a louvered vent on an upper surface of the container. In this example, the louvered vent includes a series of louvers that are moveable for selectively opening and closing the louvered vent. The example method can further involve storing the compressed gas in a storage tank that is disposed on an upper surface of the container. Optionally, the supply of hydrocarbon gas is a hydrocarbon gas utility line having hydrocarbon gas at a pressure that ranges from around 0.5 psig to around 200 psig, and wherein the compressed gas is at a pressure of at least around 3000 psig. The supply of hydrocarbon gas can be a hydrocarbon gas transmission line having hydrocarbon gas at a pressure that ranges from around 200 psig to around 1500 psig, and wherein the compressed gas is at a pressure of at least around 3000 psig. The method can further optionally involve controlling the compressor package with a controller that is provided in the shipping container and is accessible by a door hingedly mounted on the shipping container. Alternatively, the shipping container is an International Standards Organization (ISO) shipping container.

Also disclosed is a method of generating a supply of compressed hydrocarbon gas for use by a vehicle that includes providing a shipping container and installing a compressor package in the ISO shipping container to define a modular compressed gas unit. In this example, the shipping container is an International Standards Organization (ISO) shipping container, in which access elements are provided in the ISO shipping container so that substantially all maintainable components in the compressor package are accessible; and a louvered vent is provided on an upper surface of the ISO shipping container. The louvered vent has selectively movable louvers that open and close the vent, the method involves moving the louvers in a direction to open the vent when the compressor package is operating, and moving the louvers in an opposite direction to close the vent when the compressor package is at rest. The modular compressed gas unit is transported to a location proximate a supply of hydrocarbon gas and hydrocarbon gas is directed from the supply to the compressor package where it is compressed to generate compressed gas and then directed to a compressed gas dispenser. The method may further include providing a dryer in the ISO shipping container, attaching an end of a regeneration line to the dryer and locating another end of the regeneration line outside of the ISO shipping container, flowing the natural gas through the dryer, removing the dryer from communication with the natural gas, and removing moisture from the dryer by flowing a regeneration gas through the dryer. A control unit may be provided in the ISO shipping container that has a touch screen for communication with the compressor package and for manually controlling the compressor package; the control unit may also include a controller for automated control of the compressor package. In one example the modular compressed gas unit is disposed at grade. Optionally, the modular compressed gas unit is elevated, such as over a structure that houses a business. In another alternate embodiment, the modular compressed gas unit is mobile, that in an example involves providing wheels with the modular compressed gas unit, or setting the unit on a trailer.

Further disclosed herein is an example of a modular system for compressing a gas that includes a container and a compressor package disposed in the container. The compressor package has an inlet line connected to a supply of hydrocarbon gas and an outlet in selective communication with a dispenser accessible by a consumer of compressed hydrocarbon gas. One or more storage tanks are mounted on an upper surface of the housing that are in selective communication with the outlet. A louver vent is included that is placed on the upper surface of the housing and is made up of planar louvers that are mounted in parallel, and rotatable from a generally horizontal orientation to define an obstruction between an inside and outside of the housing to a generally vertical orientation to provide communication between the inside and outside of the housing. In one example, the supply of hydrocarbon gas is a utility line that is in communication with a distribution system that supplies hydrocarbon gas to residential and commercial customers. The container can be an International Standards Organization (ISO) shipping container. Selectively removable vents are optionally included that mount in openings in a sidewall of the housing and strategically located so that substantially all components in the compressor package are accessible when all components are installed in the container.

BRIEF DESCRIPTION OF DRAWINGS

Some of the features and benefits of the present invention having been stated, others will become apparent as the description proceeds when taken in conjunction with the accompanying drawings, in which.

Figure 1:
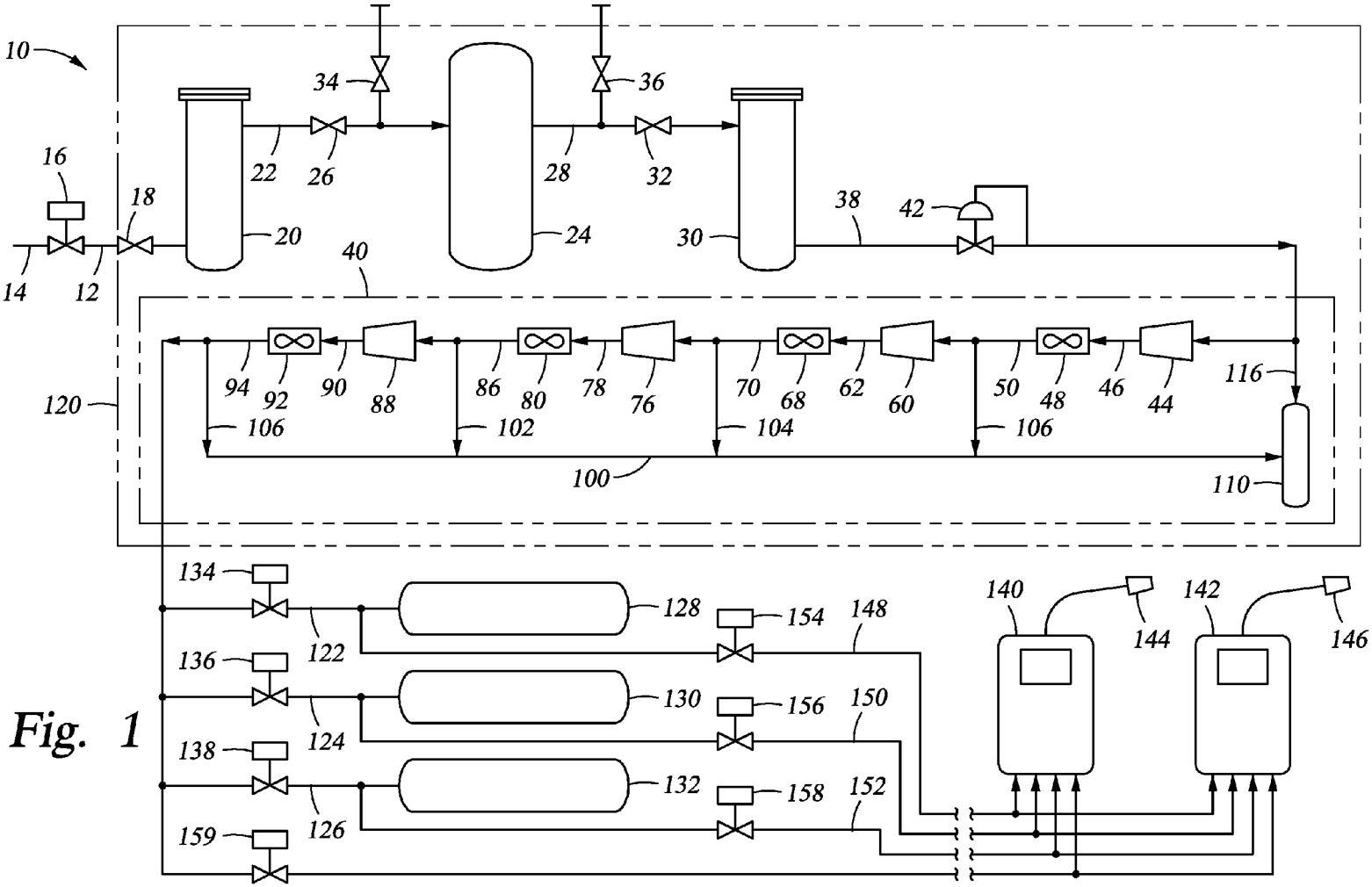
FIG. 1 is a schematic example of a compressed natural gas system disposed in a container in accordance with the present disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic illustration of a compressed gas (CG) system 10 shown having an inlet line 12 for delivering gas to the CG system 10. The inlet line 12 attaches to a supply line 14; which in an example is in communication with a utility distribution system that distributes natural gas to residential and commercial customers of natural gas, and operates at example pressures of from about 0.5 psig to about 200 psig. Alternatively, the supply line 14 can be in communication with a transmission line and having example operating pressures of from about 200 psig to about 1500 psig. Example gases include hydrocarbons that are a gas at standard temperature and pressure, such as but not limited to methane, ethane, propane, butane, and mixtures thereof. In an example, the hydrocarbons can be saturated or unsaturated, and the gas can include trace amounts of non-hydrocarbons, such as nitrogen, hydrogen, oxygen, sulfur. A shut-off valve 16, which may optionally be automated or manual, is shown at the connection between the inlet line 12 and supply line 14 for selectively blocking communication between the inlet line 12 and supply line 14. Optionally, an additional valve 18 may be provided in the inlet line 12 downstream of valve 16. Inlet line 12 terminates at a filter 20, which may be used for removing particles and other non-desirable matter from within a stream of gas flowing within the inlet line 12. Filter 20 connects via line 22 to a dryer 24, which may include a desiccant for removing moisture from the gas stream. Optionally, dryer 24 can be empty and provide an open space to operate as a knockout drum thereby removing moisture by gravity separation. Valve 26 is disposed in line 22 for selectively blocking flow between filter 20 and dryer 24. An outlet line 28 connects dryer 24 to a second filter 30 for additional filtering downstream of the dryer 24. Valve 32 is shown in line 28 and selectively blocks communication between dryer 24 and filter 30. Optional regeneration lines 34, 36 are shown connecting respectively to line 22 and line 28 between the dryer 24 and valves 26, 32. Desiccant in the dryer 24 can be regenerated by closing valves 26, 32 to isolate dryer 24, opening valves in regeneration lines 34, 36, and circulating a hot and/or dry gas through regeneration lines 34, 36 and dryer 24. Line 38 connects to filter 30 on one end and to a compressor package 40 on another for transmitting gas from the filter 30 to be compressed within the compressor package 40. A pressure control valve 42 is shown in line 38 for controlling the flow of gas within line 38.

The example compressor package 40 of FIG. 1 is shown having a first stage compressor 44 wherein in an example, the compressor 44 is a reciprocating compressor. Line 46 connects an outlet of the first stage compressor 44 with a first interstage cooler 48. In the example of FIG. 1, first interstage cooler 48 is air cooled, but other cooling mediums may be employed. An outlet line 50 from the first interstage cooler 48 connects to an inlet of a second stage compressor 60. In the second stage compression section of the compressor package 40 of FIG. 1, the exit or discharge of the second state compressor 60 connects to line 62 that has an opposite end connecting to a second interstage cooler 68. A discharge of the second interstage cooler 68 attaches to line 70 that in turn connects to an inlet of a third stage compressor 76. Line 78 has an end connecting to a discharge of third stage compressor 76 and an opposite end connecting to an inlet of a third interstage cooler 80. Line 82 shown connecting to an exit of the third interstage cooler 80 and an inlet of a fourth stage compressor 88. An exit of the fourth stage compressor 88 connects to line 90, which is shown having an opposite end connecting to an inlet of fourth interstage cooler 92. Line 94 connects an exit of the fourth interstage cooler 92 and provides a transmission line for discharging compressed gas from the compressor package 40. Thus, in one example, the compressor package 40 receives gas at about the pressure in the supply line 14 and compresses the gas to pressures in excess of about 3000 psig, and alternatively to pressures in excess of about 3600 psig. Optionally, the discharge pressure end line 94 can be in excess of about 4000 psig, and alternatively to pressures in excess of about 4700 psig. Compressors for use with the method and system described herein are not limited to four stage compressors; alternative embodiments exist wherein the gas is compressed with a compressor having, one stage, two stages, three stages, five stages, or more than five stages.

Further illustrated in FIG. 1, are blowdown lines 100, 102, 104, 106 that connect respectively to lines 50, 70, 82, 94 and terminate in blowdown header 108. Blowdown header 108 connects to blowdown drum. Thus, in situations where operation of the compressor package 40 is terminated, either planned or not, compressed gas within the various stages of the compressor package 40 can be directed to the blowdown drum 110, where upon restart of a compressor package 40, gas in the blowdown drum 110 can flow through line 116 and return to line 38 as shown and to an inlet of the compressor package 40.

Still referring to FIG. 1, the filters 20, 30, dryer 24, and compressor package 40 are schematically illustrated as being within container 120, wherein valve 18 is disposed just inside of container 120. As will be described in more detail below, example containers may include those manufactured to an international standards organization (ISO) and more specifically to ISO standard 6346. An advantage of a standardized container housing the CG system 10 is that after the CG system 10 is installed in the container 120, the container 120 and its contents are readily transported as a single modular unit. This is because most shippers of freight use vehicles (e.g. trains, tractor trailer rigs, cargo ships) equipped to receive and stow a standardized shipping container. Moreover, attachment points provided on a readily available ISO container enable them to be safely secured in or on a shipping vehicle.

The CG system 10 of FIG. 1 further includes lines 122, 124, 126 that branch from a portion of the line 94 downstream of the compressor package 40. Lines 122, 124, 126 respectively connect to an inlet of storage tanks 128, 130, 132. Although three storage tanks 128, 130, 132 are illustrated, embodiments exist of the CG system 10 disclosed herein having zero, one, two, four, and more than four storage tanks. Schematically shown in FIG. 1, the storage tanks 128, 130, 132 are substantially elongate and cylindrical members that in one example are arranged in parallel and mounted on a upper surface of container 120. In an alternative, the tanks 128, 130, 132 can be provided on side or lower surfaces of the container 120, or separate from the container 120, such as at grade. Valves 134, 136, 138 are respectively provided in lines 122, 124, 126 and are for selectively regulating flow to tanks 128, 130, 132.

Gas compressed in CG system 10 can be accessible to end users of the compressed gas via dispensers 140, 142. Nozzles 144, 146 on dispensers 140, 142 provide a flow path for gas compressed in the CG system 10 to a vehicle (not shown) or other storage vessel for compressed gas purchased by a consumer. Thus, dispensers 140, 142 may be equipped with card readers or other payment methods so that a consumer may purchase an amount of compressed gas at the dispensers 140, 142. Although two dispensers 140, 142 are shown, the CN system 10 can have one, three, or more than three dispensers. Lines 94, 148, 150, 152 provide example flow paths between the CG system 10 and dispensers 140, 142. In the example of FIG. 1, lines 148, 150, 152 have an inlet end connected to lines 122, 124, 126 and downstream of valves 134, 136, 138. Valves 154, 156, 158 are provided respectively in lines 148, 150, 152; selective opening and closing of valves 154, 156, 158 in combination with selective opening and closing of valves 134, 136, 138, 159 selectively deliver compressed gas to storage tanks 128, 130, 132 or directly to dispensers 140, 142. Optionally, gas stored within tanks 128, 130, 132 can be selectively delivered through one of lines 148, 150, 152 by the closing of valves 154, 156, 158. In one example, compressed gas can flow directly from the compressor package 40 through line 94 to the dispensers 140, 142. In this example, valve 159 in line 94 is open to allow flow through line 94.

Figure 2:
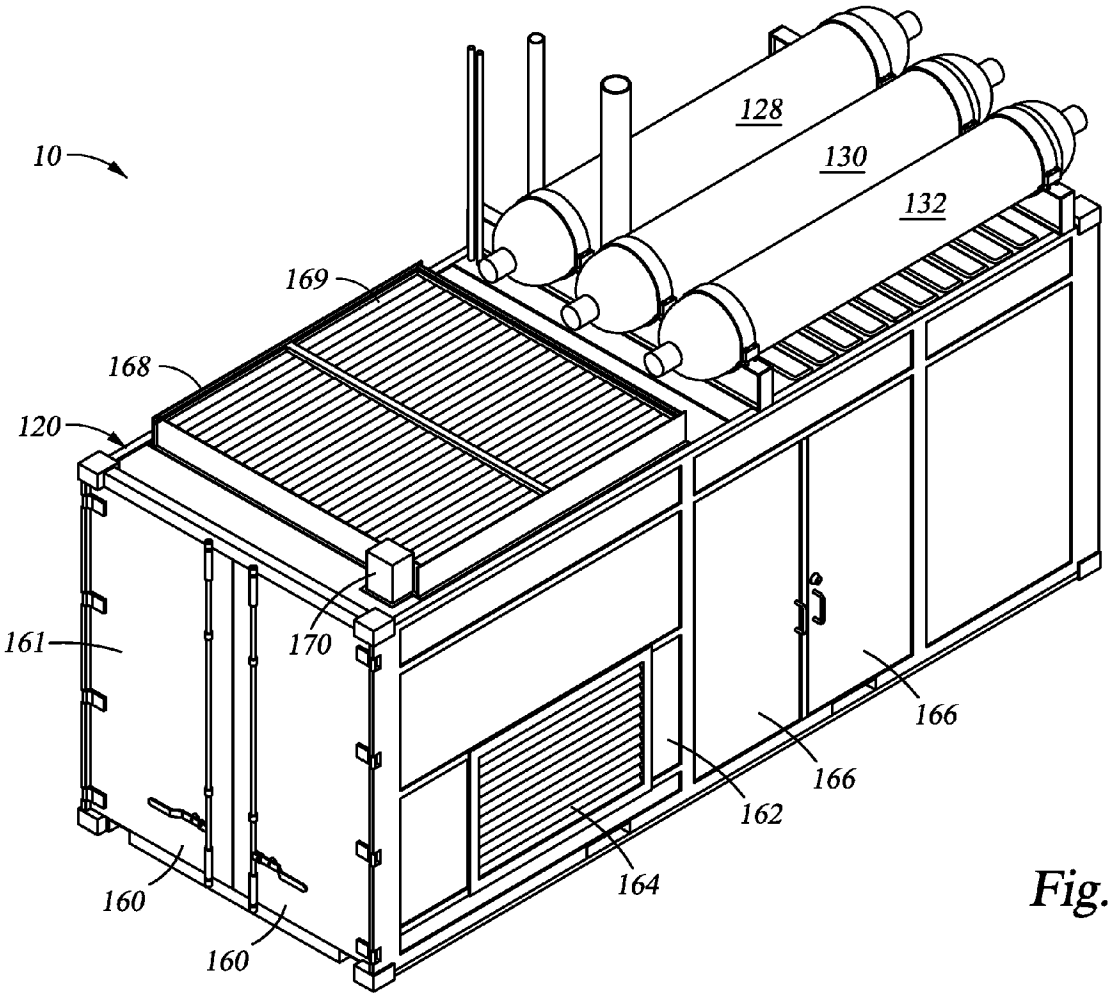
FIG. 2 is a perspective view of a front end of the container of FIG. 1 in accordance with the present disclosure.

Referring now to FIG. 2, shown in a perspective view is an example embodiment of the CG system 10 housed in container 120. In the example of FIG. 2, the container 120 is an ISO shipping container and having hinged doors 160 on a forward end 161 of the container 120. The doors 160 have vertical locking rods for securing the doors 160 closed. Horizontally oriented structure members are further illustrated at spaced apart vertical locations on the doors 160. Hinges on the opposite lateral ends of the doors 160 mount the doors to lateral sides of the container 120, the hinged attachments allow outward opening of the doors 160 and maximize access to within the container 120 from the forward end 161. An opening is shown formed on a lower panel of a right lateral side 162 of the container 120. A vent 164 is mounted in the opening, and may be retained therein by fasteners (not shown) that are readily removed thereby allowing quick and repeated access to within the container 120 via the opening. Lateral doors 166 are shown provided onto the right lateral side 162 having hinges on opposing lateral sides and handles for opening of the doors 166. In an example, a standard ISO shipping container was modified by adding the opening for the vent 164 and the lateral doors 166.

Further shown in the example of FIG. 2 is a louvered vent 168 provided on an upper surface of the container 120. The louvered vent 168 mounts in a rectangularly shaped frame that is generally coplanar with the upper surface of the container 120. However, the louvered vent 168 can be on any surface of the container 120, including the side and lower surfaces. A series of elongate louvers 169 within the frame extend along a line generally parallel with the lateral side of the container 120. However, the louvers 169 may be oriented in other directions. The louvers 169 are mechanically coupled with actuator 170 shown set in a housing adjacent the frame of the louvered vent 168. As will be described in more detail below, energizing the actuator 170 allows the louvers 169 to rotate about an axis that extends along their elongate length. Thus, communication between an inside and outside of the container 120 may selectively take place by operation of the actuator 170. An advantage of a closable louvered vent 168 is the prevention of precipitation, debris, and other materials from entering into the container 120 that may harm or otherwise limit the life of the CG system 10 retained therein.

Optionally, the louvers 169 can be cycled to prevent ice or snow buildup on the louvered vent 168. In another alternative, the louvers 169 can be closed to retain thermal energy within the housing 120 so that the machinery and other components in the CG system 10 can be maintained within a designated ambient operational environment. In another alternative, a motor (not shown) for driving fan 180 (FIG. 5) can have a varying output speed, such as by implementing a variable speed controller, to regulate temperature inside the container 120.

Still referring to FIG. 2, tanks 128, 130, 132 are shown mounted on elongate supports that extend between lateral sides of the container 120 on the upper surface of the container 120. Semicircular recesses are formed in the supports that provide a seat for the tanks 128, 130, 132. Straps are fastened to the support and extend over the upper surface of the tanks 128, 130, 132 for securing the tanks 128, 130, 132 to the supports and to the container 120. Also on the upper surface of the container 120 are annular risers extending upward for venting gas relieved from the CG system 10 as needed.

Figure 3:
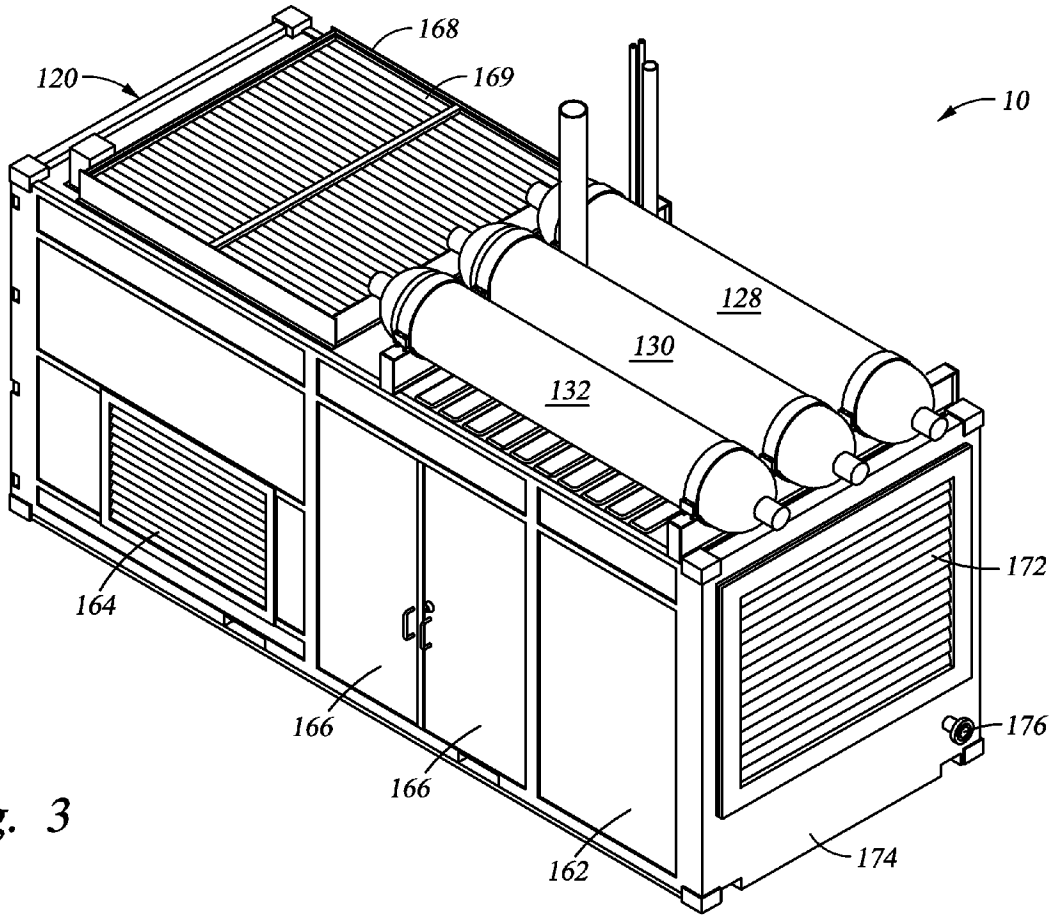
FIG. 3 is a perspective view of a rearward end of the container of FIG. 1 in accordance with the present disclosure.

Referring to FIG. 3, illustrated is a perspective view of the CG system 10 and container 120, with a vent 172 releasably mounted in an opening formed in a rearward end 174 of the container 120. Similar to vent 164, vent 172 can be mounted with fasteners that allow for easy removal of vent 172 for access to components of the CG system 10 within container 120. Also set on the rearward end 174 of container 120 is a flanged fitting 176 mounted on end of inlet line 12 (FIG. 1) for connecting to valve 16 (FIG. 1) and supply line 14 (FIG. 1). Accordingly, in one example, the CG system 10 is installed within container 120 at an installation facility, and transported to a location proximate a supply line, and a tie-in can be made between the supply line and CG system 10 via flanged fitting 176.

Figure 4:
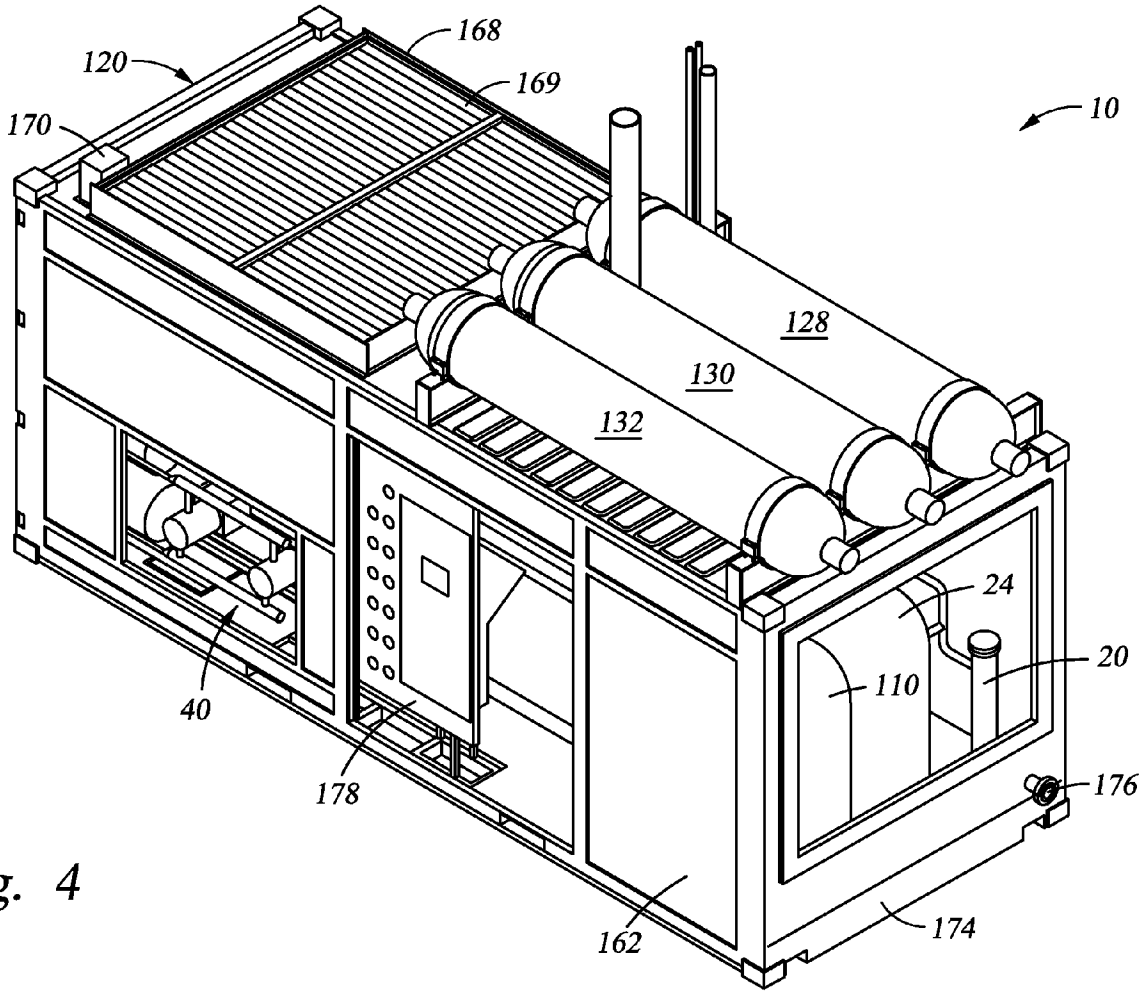
FIG. 4 is a perspective view of a rearward end of the container of FIG. 1 having elements removed from the container in accordance with the present disclosure.

FIG. 4 illustrates a side perspective view of the CG system 10 within container 120, wherein vent 174 (FIG. 3), lateral doors 166 (FIG. 2), and vent 164 (FIG. 2) have been removed. As noted above, the vents 172, 164 may be easily removed thereby providing access to components of the CG system 10 that may need maintenance. As can be seen in the example of FIG. 4, readily accessible from the outside of the container 120 are the filter 20, dryer 24 and blowdown drum 110. Also shown are portions of the compressor package 40 that are readily accessible via opening in which vent 164 (FIG. 2) may be set. Further illustrated in FIG. 4 is a control panel 178 mounted in the container 120 and set back inward from the opening where the lateral doors 166 (FIG. 3) are installed. As will be discussed in more detail below, control panel 178 can provide an interface for manual operation of the CG system 10 and can also include gages for pressure and temperature of the gas within the CG system 10.

Figure 5:
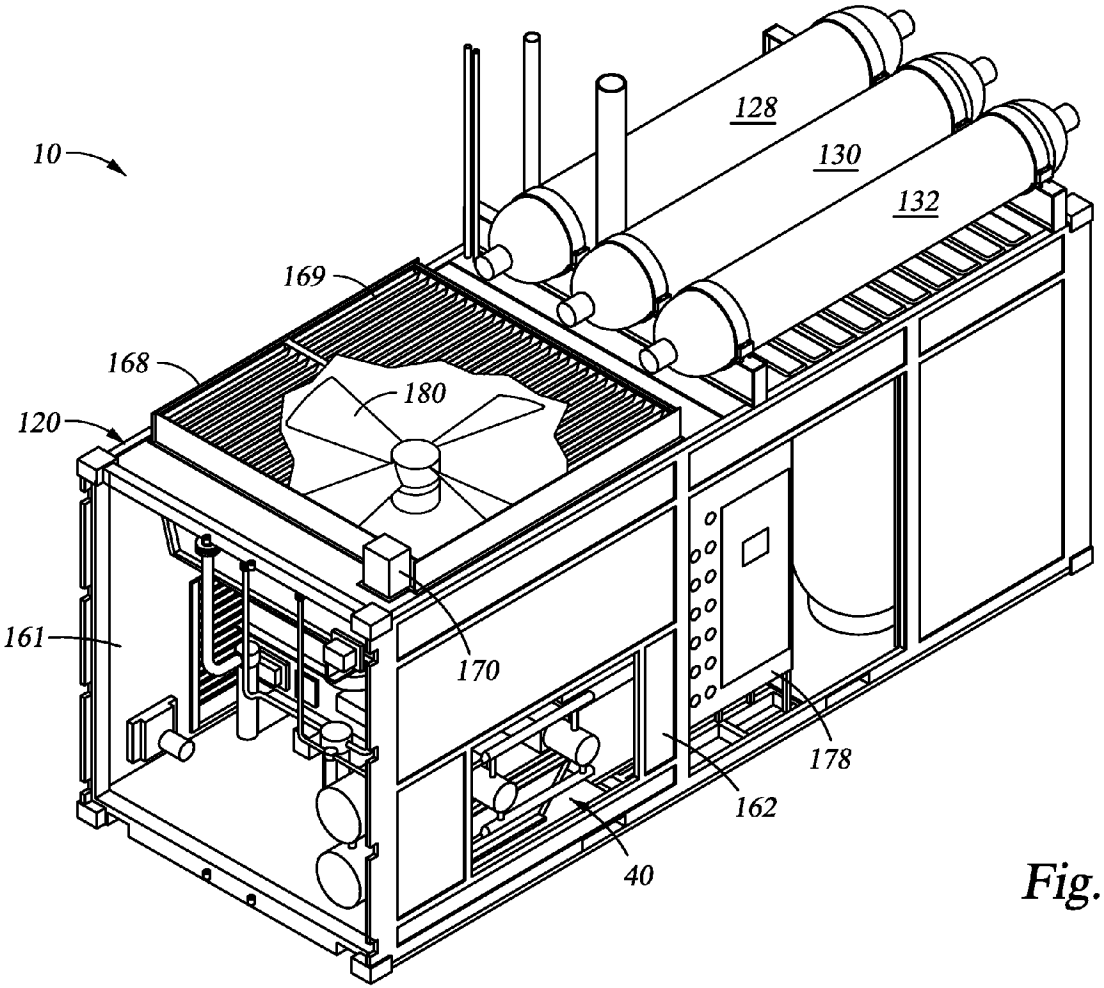
FIG. 5 is a perspective view of a front end of the container of FIG. 1 having elements removed from the container and a louvered vent in an open position and in accordance with the present disclosure.

FIG. 5 is a side perspective view showing doors 160 (FIG. 2) removed from the forward end 161 of the container 120. In one example, openings are provided at strategic locations on the sidewalls of container 120 in which readily replaceable and removable vents are disposed so that access to all maintainable items within the CG system 10 is available and without removing any components of the CG system 10. Additionally illustrated in FIG. 5 is that the actuator 170 has been energized to rotate louvers 169 so that communication between the outside and inside of the container 120 is available through the louvered vent 168. To facilitate air flow through the container 120, an optional fan 180 is shown set in the container 120 and beneath the louvered vent 168. Selective closing of the louvered vent 168 by operation of the actuator 170 and louvers 169 limits an inflow of debris, precipitation, or other such substances, through the louvered vent 168 that may land on the fan and/or other working components of the CG system 10. Reducing the introduction of foreign material inside of the container 120 optimizes performance of the CG system 10 and prolongs its life.

Figure 6:
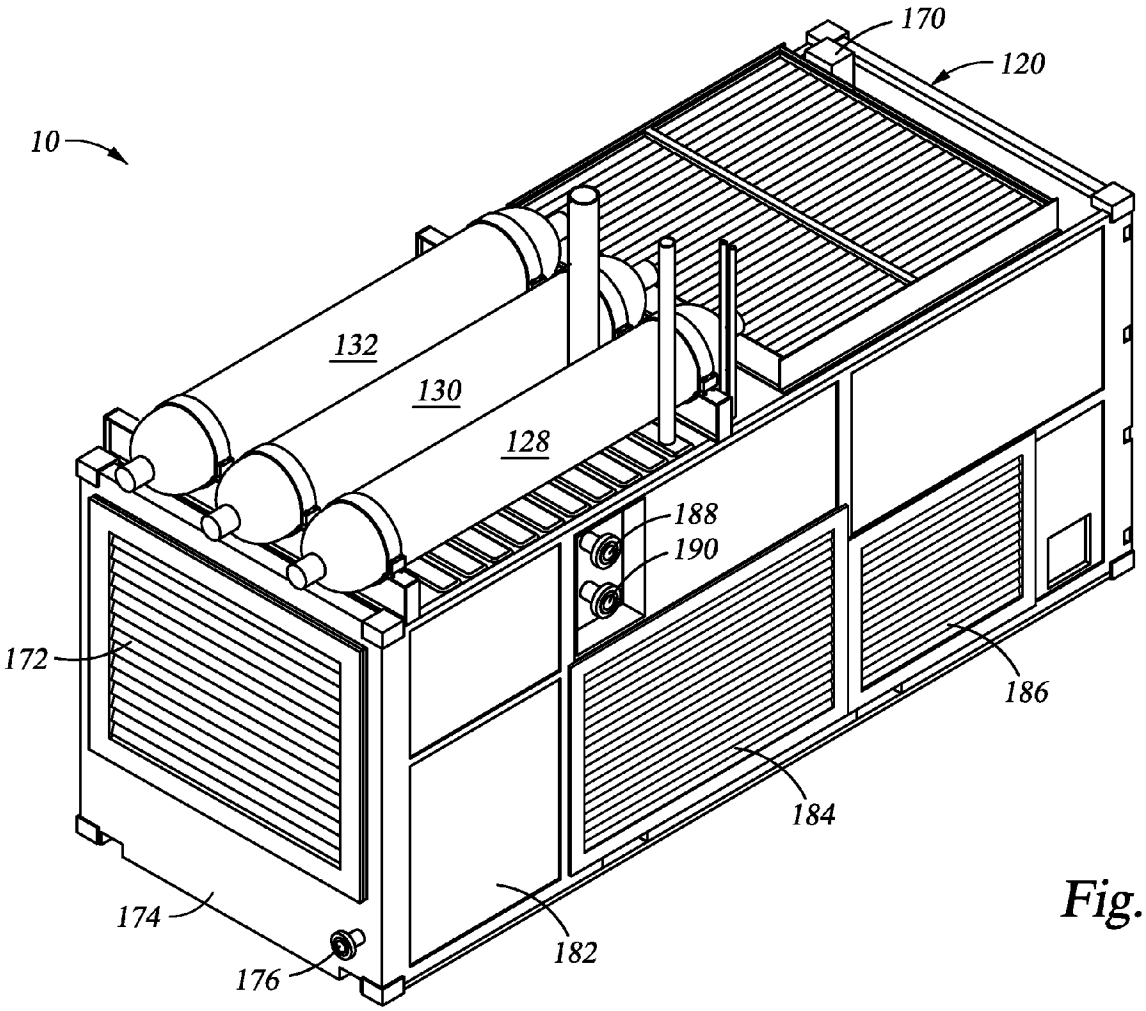
FIG. 6 is a perspective view of a rearward end of the container of FIG. 1 in accordance with the present disclosure.

FIG. 6 illustrates a perspective view of the CG system 10 within container 120 and illustrates a left lateral side 182 and rearward end 174 of container 120. In this example, illustrated are vents 184, 186 set within openings provided on the left lateral side 182. Also on the left lateral side 182 of this example are flanged fittings 188, 190 that connect to regeneration lines 34, 36 for selective regeneration of the dryer 24. Thus, another additional advantage of the selective placement of flanged fittings is the ability to regenerate the dryer 24 from outside of the container 120.

Figure 7:
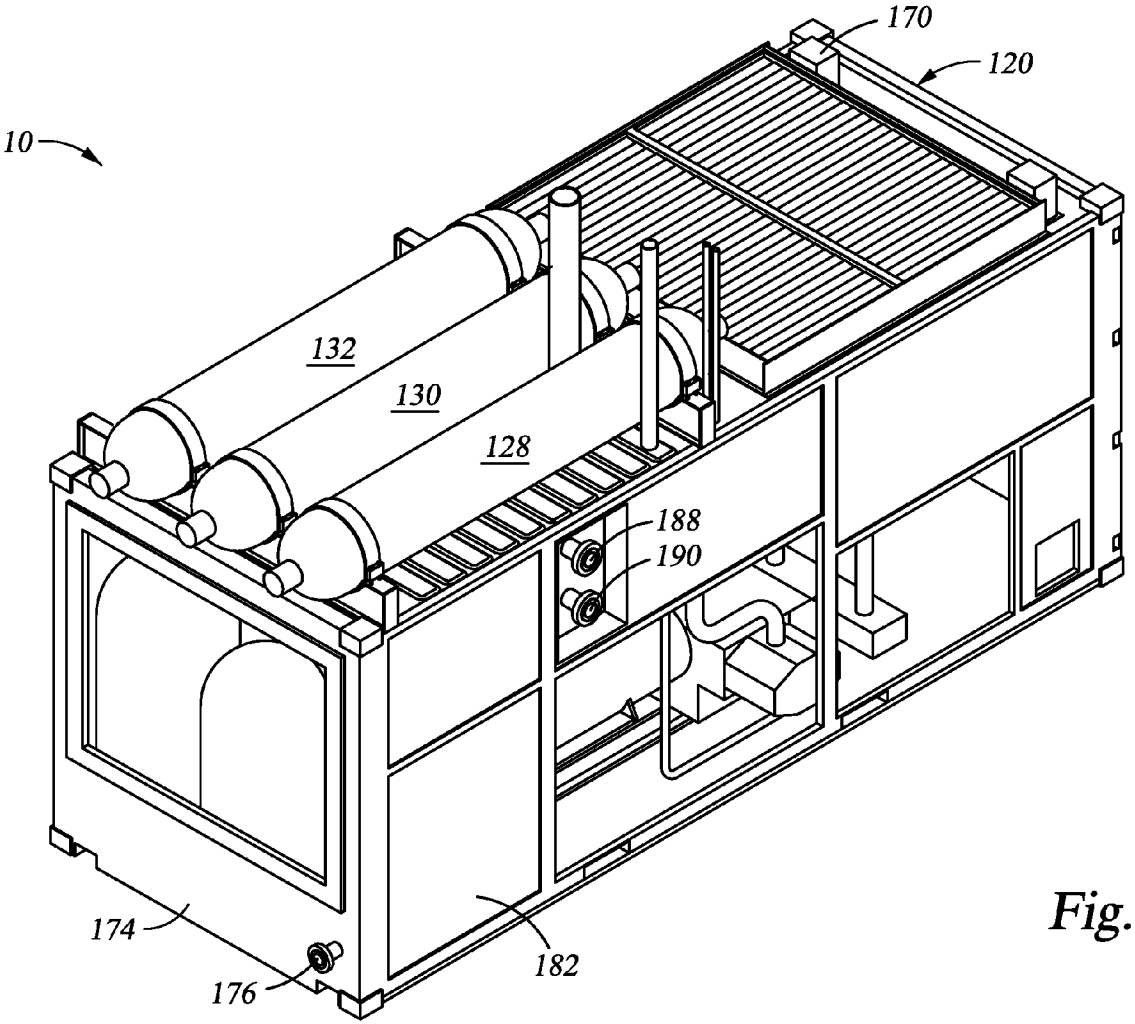
FIG. 7 is a perspective view of a rearward end of the container of FIG. 1 having elements removed from the container in accordance with the present disclosure.

FIG. 7 illustrates a similar view of FIG. 6 of the CG system 10 and container 120 but with vents 184, 186 missing from the openings on the left lateral side 182. Also missing is vent 172 on the rearward end 174 (FIG. 3). Removal of vents 184, 186 further illustrates the advantage of selective placement of openings in the sidewalls of container 120 so that access to components of the CG system 10, such as compressor package 40, is made convenient. However, during expected operation of the CG system 10 the vents will be in place in the openings thereby providing a barrier to trespass and other unwanted intrusions within the container 120.

Figure 8:
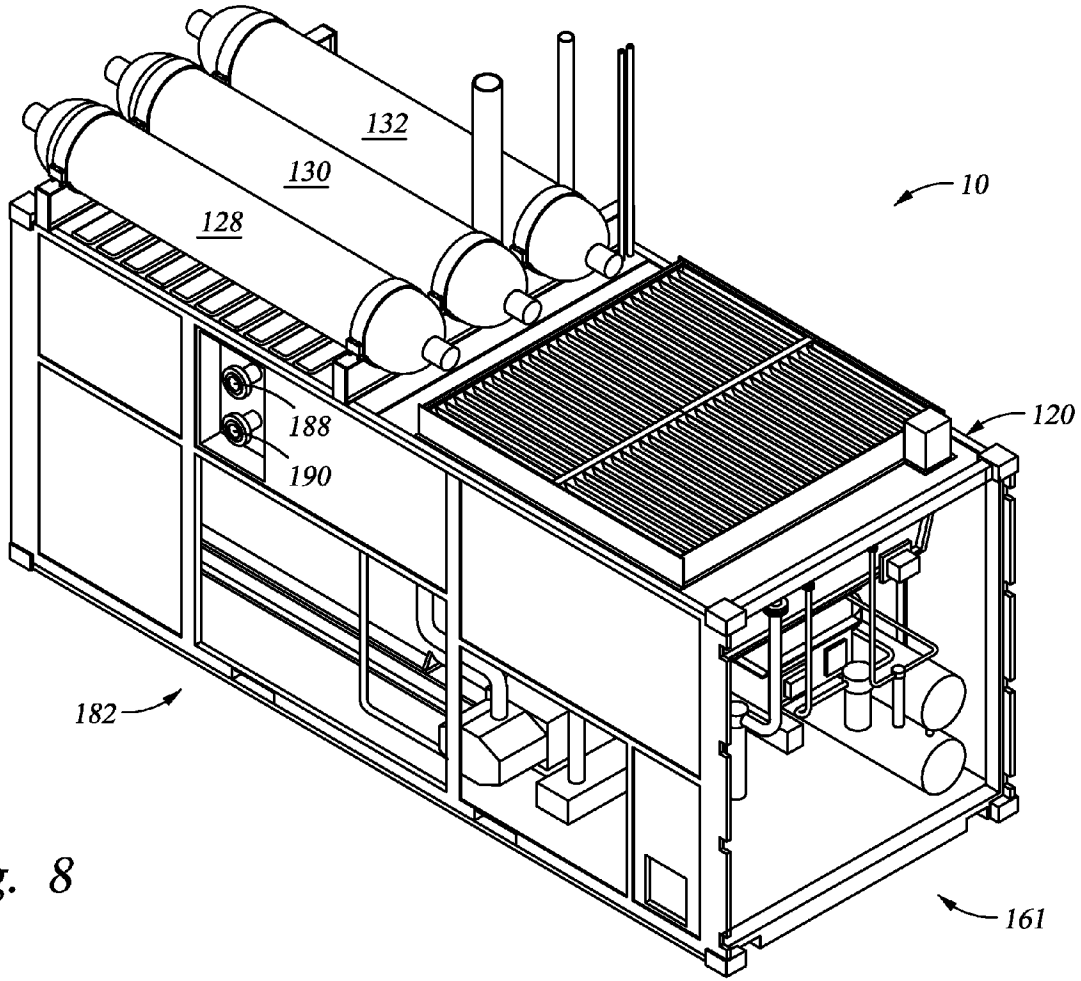
FIG. 8 is a perspective view of a front end of the container of FIG. 1 having elements removed from the container and a louvered vent in an open position and in accordance with the present disclosure.

FIG. 8 shows a perspective view of the CG system 10 within container 120, and illustrates doors 160 removed from the forward end 161 of the container 120. Also removed are vents 184, 186 (FIG. 6) and vent 164 (FIG. 3). FIG. 8 further illustrates the accessibility of components in the CG system 10 by strategically positioning the openings in the sidewall in the container 120. Moreover, strategic orientation of the components within the CG system 10 inside the container 120 contributes to the accessibility features of the CG system 10 described herein. For example, orienting the compressor package 40 so that throws or stages of the compressor package 40 point towards the openings in the right and left lateral sides 162, 182 enable ready access to components having a higher frequency of maintenance and/or repair. As such, the vents, doors, and/or panels described herein can be designated as a service element that can be removed to provide access to the CG system 10.

Figure 9:
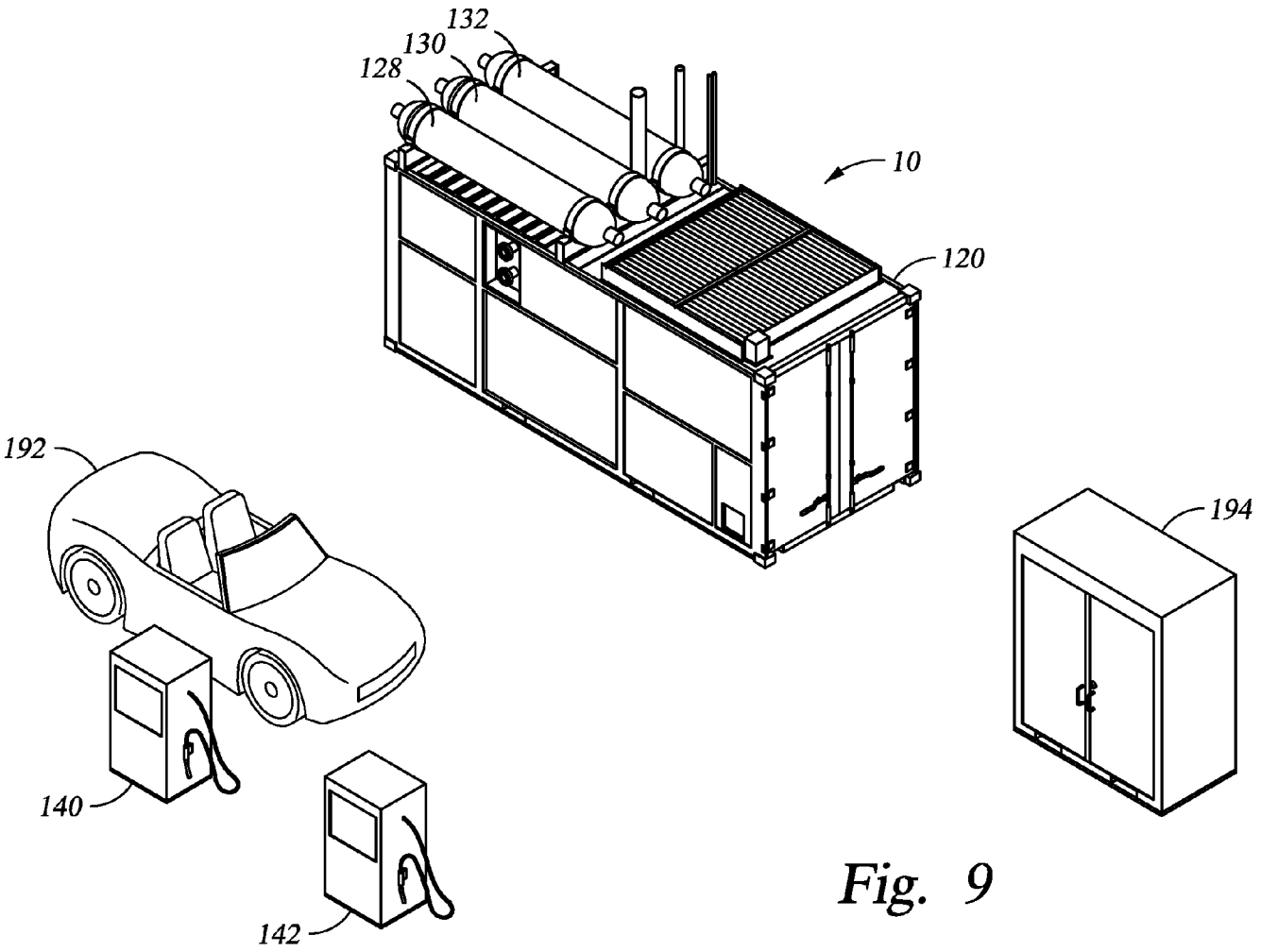
FIG. 9 is a perspective view of an example of the compressed hydrocarbon gas system in a container of FIG. 1 disposed adjacent dispensers and a power supply to form a fueling station in accordance with an embodiment of the present disclosure.

FIG. 9 illustrates an example of a consumer obtaining compressed gas from dispensers 140, 142. In this example, the CG system 10 within container 120 is set at a fueling station wherein a vehicle 192 is positioned for fueling with compressed gas from dispensers 140, 142. In the example, the dispensers 140, 142 are spaced away from container 120, and supply lines from the tanks 128, 130, 132 may be piped underground to the dispensers 140, 142. Alternatively, the dispensers 140, 142 can be integrated in the housing 120, so that the nozzles can mount directly to the housing 120 rather than to the dispensers 140, 142. Further provided in FIG. 9 is an example of a power box 194 that provides a connection point for utility supplied power for powering the CG system 10. In one example, the power box 194 is set a distance from the container 120 for safety reasons. In an embodiment, the power box 194 includes one or more of a transformer for control power, circuit breakers, starters for small motors, an exterior disconnect handle, emergency stop push button, and an uninterrupted power supply. FIG. 9 illustrates an example of the CG system 10 being manufactured in the container 120 at a manufacturing location, and then having been shipped to the fueling station, where a supply line 14 (FIG. 1) is located at or proximate the fueling station. Thus after the CG system 10 in the container 120 is delivered to the fueling station the inlet line 12 (FIG. 1) is connected to the supply line 14.

Figure 10:
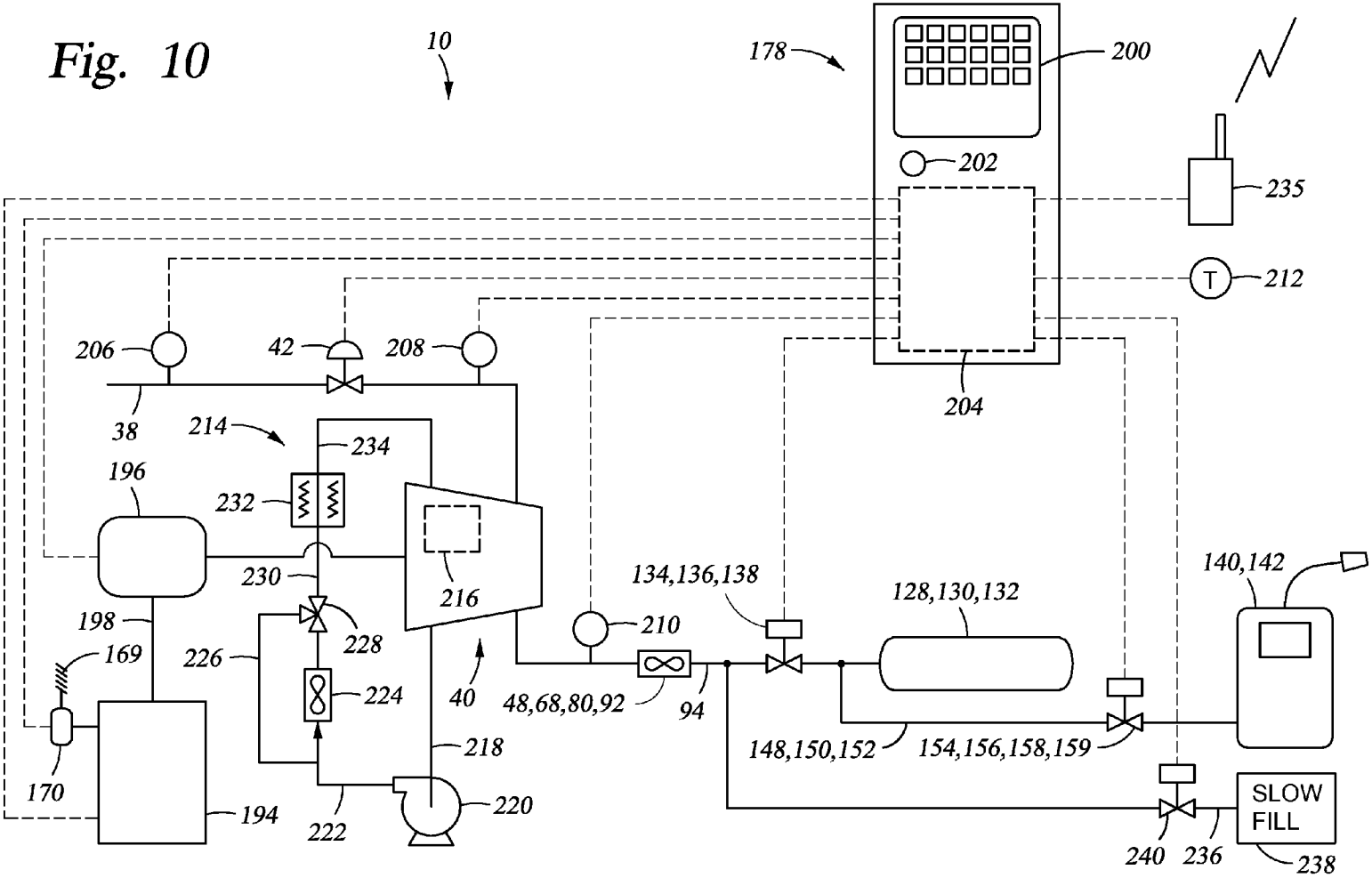
FIG. 10 is a schematic example of a portion of an embodiment of the compressed hydrocarbon gas system of FIG. 1 in communication with a controller in accordance with an embodiment of the present disclosure.

Schematically illustrated in FIG. 10 is a portion of the CG system 10 wherein the compressor package is represented by a single compressor with an inlet connected to line 38 and outlet to line 94. Moreover, valves 134, 136, 138 of FIG. 1 are represented as a single valve in line 94, and lines 148, 150, 152 are represented by a single line connecting line 94 to dispensers 140, 142. Similarly, tanks 128, 130, 132 are represented by a single tank and valves 154, 156, 158 are represented by a single valve. Further illustrated in FIG. 10 is that power box 194 is shown schematically powering a motor 196 via power line 198. In the example of FIG. 10, motor 196 is used for driving the compressor package 40. Additionally, control panel 178 is schematically depicted as including a touch screen 200 having various buttons for controlling operation of the CG system 10 as well as display features for visually monitoring conditions within the CG system 10. An emergency stop button 202 or master switch is included on the example of the control panel 178 of FIG. 10. Also within control panel 178 is a controller 204 that in some examples may include a programmable logic controller (PLC). The controller 204 is shown in communication, either via hardwire, wireless, or software links, with various components within the CG system 10. In one example, a dew point meter 206 is shown mounted on inlet line 38 and upstream of control valve 42. The dew point meter 206 connects with controller 204 wherein controller 204 can display signals from the dew point meter 206 and/or use information from the dew point meter 206 for controlling operation of the CG system 10. Example operational controls may include affecting the speed or shutting down the compressor package 40 as well as regenerating the dryer 24 (FIG. 1). As an alternative to the motor 196, optional drivers for the compressor package 40 include turbines, gas turbines, engines, and any machine that converts energy into useful mechanical motion.

Further illustrated in FIG. 10, control valve 46 also connects to controller 204 wherein signals may be received by the control valve 42 to regulate the amount of flow through line 38. Pressure taps with pressure indicators 208, 210 are shown in line 38 and line 94 respectively upstream and downstream from the compressor package 40. Signals from the pressure indicators 208, 210 may be communicated to controller 204. Additionally, actuator 170 is shown in communication with controller 204 so that selective operation of the actuator 170 may take place via signals from controller 204 for actuation of louvers 169. A temperature sensor 212 is further illustrated in the example of FIG. 10, where the temperature sensor 212 monitors temperature inside the housing 120 (FIG. 1). The temperature sensor 212 is shown in communication with controller 204, and thus in an example signals are transmitted from the temperature sensor 212 to the controller 204 that represent temperature in the housing 120. Optionally, control of the louvers 169 (and thus actuator 170) can depend on a sensed temperature in the housing 120 by the temperature sensor 212, so that when a designated temperature is sensed, the controller 204 can be programmed to command the actuator 170 to either open or close the louvers 169 for decreasing or increasing temperature in the housing 120. In the example of FIG. 10, air cooler downstream of compressor package 40, which represents the first, second, third, and fourth stage intercoolers 48, 68, 80, 92 (FIG. 1) may be positioned adjacent the louvers 169 and wherein fan 180 provides cooling across these interstage coolers 48, 68, 80, 92. Additionally illustrated in FIG. 10 are that valves 134, 136, 138 are in communication with controller 204 as well as valves 154, 156, 158, 159. Thus, flow through lines 94 and/or lines 148, 150, 152 can be controlled via the controller 204 by manipulation of valves 134, 136, 138 and/or 150, 156, 158, 159 so that flow from the compressor package 40 can flow directly to the storage tanks 128, 130, 132 or direct flow to dispensers 140, 142. Control of the motor 196 can also take place from the controller 204 via a signal line connecting to the controller 204. Additional communication is shown between the power box 194 and controller 204. Signal line can provide data within the power box 194 to controller 204 such as usage of electricity and rates of usage and in some conditions may signal a situation, such as detection of a gas leak or a fire, wherein the controller 204 disconnects power from the power box 194 to the CG system 10.

An embodiment of the CN system 10 exists where a pressure sensor (not shown) in one or more of the dispensers 140, 142 senses pressure in the receptacle (not shown) in which the compressed gas is being dispensed. Where the receptacle can be a tank within a vehicle for storing fuel for the vehicle, or a standalone vessel that is transported away from the CN system 10 after receiving compressed gas. In an example, a designated amount of compressed gas is metered into the receptacle from a dispenser 140, 142, and gas flow from the dispenser 140, 142 is suspended while pressure in the receptacle is measured. Based on the measured value of pressure, an amount of gas (mass or volume) can be estimated required to fill the receptacle. In an example embodiment, the controller is programmed to consider the estimated amount of gas required to fill a receptacle at one of the dispensers 140, and provide a greater flow of compressed gas to the receptacle having the smaller capacity. For example, if dispenser 140 is being accessed to fill a receptacle having a large capacity, and dispenser 142 (or an additional dispenser) is being accessed to fill a receptacle of smaller capacity, flow from dispenser 140 can be given priority over dispenser 142. In one example, giving priority to dispensers 140, 142 includes selectively metering flow from the priority dispenser 140, 142. Alternatively, priority can include closing and/or opening automated valves (not shown) in the lead lines to dispensers 140, 142 from lines 148, 150, 152, 94 (FIG. 1), and selectively closing and/or opening valves 134, 136, 138, 154, 156, 158, 159, so that some or all compressed gas in the CN system 10 flows to the dispenser 140, 142 having priority. Examples of a large capacity receptacle include a fuel tank on a bus, long haul tractor trailer rig, or the like, which may require several minutes to fill, Whereas, a smaller capacity receptacle can include a tank in a passenger vehicle or light duty truck. Prioritizing gas flow to a dispenser filling a smaller capacity receptacle maximizes the number of receptacle filled over time. For example, only a few minutes may be needed to dispense compressed gas to a smaller capacity receptacle; meaning the dispenser can quickly be available for use to fill another receptacle. In contrast, if gas flow to the dispenser dispensing to the small capacity receptacle is reduced while another dispenser dispenses to a large capacity receptacle; the total amount of time both dispensers are in use is increased.

Still referring to FIG. 10, a motor oil circuit 214 is shown for regulating temperature of oil in motor 196. Oil in compressor 40 is contained in crankcase 216 shown in dashed outline in compressor 40; which flows from the crankcase 216 into line 218 to a pump 220 for circulating oil through motor oil circuit 214. Pump 220 discharges into line 222 that carries oil to an air cooler 224. Some of the oil in line 222 is selectively diverted to downstream of air cooler 224 through a bypass line 226 that tees from line 222. Line 226 connects to a temperature controlled three way valve 228 shown in line 230, which carries oil exiting air cooler 224. Line 230 connects to a heater 232 on an end opposite where it connects to air cooler 224. Temperature in the circulating oil is maintained by the combination of the air cooler 224, the heater 232, and the three way valve 228 that regulates how much of the oil flowing through the circuit 214 flows through the air cooler 224. Oil exiting the heater 232 flows back to the crankcase 216 via line 234.

Optionally, a router 235, or other communication device, may be included for remote monitoring of the CN system 10. In an example, the router 235, which can be wireless, is in communication with the controller 204 as shown, and delivers signals to a remote monitoring facility (not shown) that represent conditions and/or operational performance of the CN system 10. Exemplary signals can represent temperatures and/or pressures at locations of the CN system 10, such as from temperature sensor 212 and/or pressure taps 208, 210, as well as signals from dew point meter 206 that can represent moisture content. Signals indicative of pressure and temperature can be from any portion of the CN system 10, and is not limited to the locations monitored by temperature sensor 212 and pressure taps 208, 210. Signals may also represent gas flow rates in the CN system 10, amount of compressed gas dispensed to each receptacle, time of dispensing to each receptacle, capacity of each receptacle receiving compressed gas, power usage of components in the CN system 10, e.g. motors 196, 170, and the detection of gas inside of the container 120. Collecting these values can be useful in evaluating operating performance of a particular CN system 10, scheduling maintenance (including regeneration of desiccant), and economic performance. In an example, information monitored, either locally or remotely, can be used to change a maintenance schedule of a component of the CN system 10 if needed, so the maintenance occurs when needed, e.g., not too soon or too late. Also, monitoring can improve maintenance staging by indicating which components of the CN system 10 might need replacement or repair; so that when serviced all required parts and/or tools are on hand. Improving maintenance staging can eliminate time to retrieve a needed part or tool, thereby reducing maintenance downtime. Additionally, data relating to dispensing of compressed gas can be useful for monitoring the economics of a CN system 10 that is selling compressed gas to consumers, and its location. For example, the number of fills (i.e. customers) over a period of time, the time to fill, and amount of gas dispensed per fill and over time, can be used to assess the value of a particular location over another. This economic information can be useful when making a decision to relocate a particular CN system 10 to another location, or install a new CN system 10 proximate an existing CN system 10.

In an alternative, a slow fill line 236 is shown connecting to line 94 and terminating at a slow fill terminal 238, which can be away from the CN system 10. The slow fill terminal 238 can be used for filling fleet vehicles, such as buses, automobiles, vans, police cars, trucks, taxis, and like, and include a header from which each item being filled connects. A slow fill procedure can take place when the items being filled are not normally in use, such as overnight, weekends, and/or holidays. An advantage of filling during non-peak time can be a cost savings due to lower energy costs to operate the CN system 10. A valve 240 is shown in slow fill line 236 and in communication with the controller 204; so that commands from the controller 204 can regulate flow through the slow fill line 236. In an example, the controller 204 could command valve 240 closed once a designated pressure is reached in the slow fill terminal 238.

Figure 11:
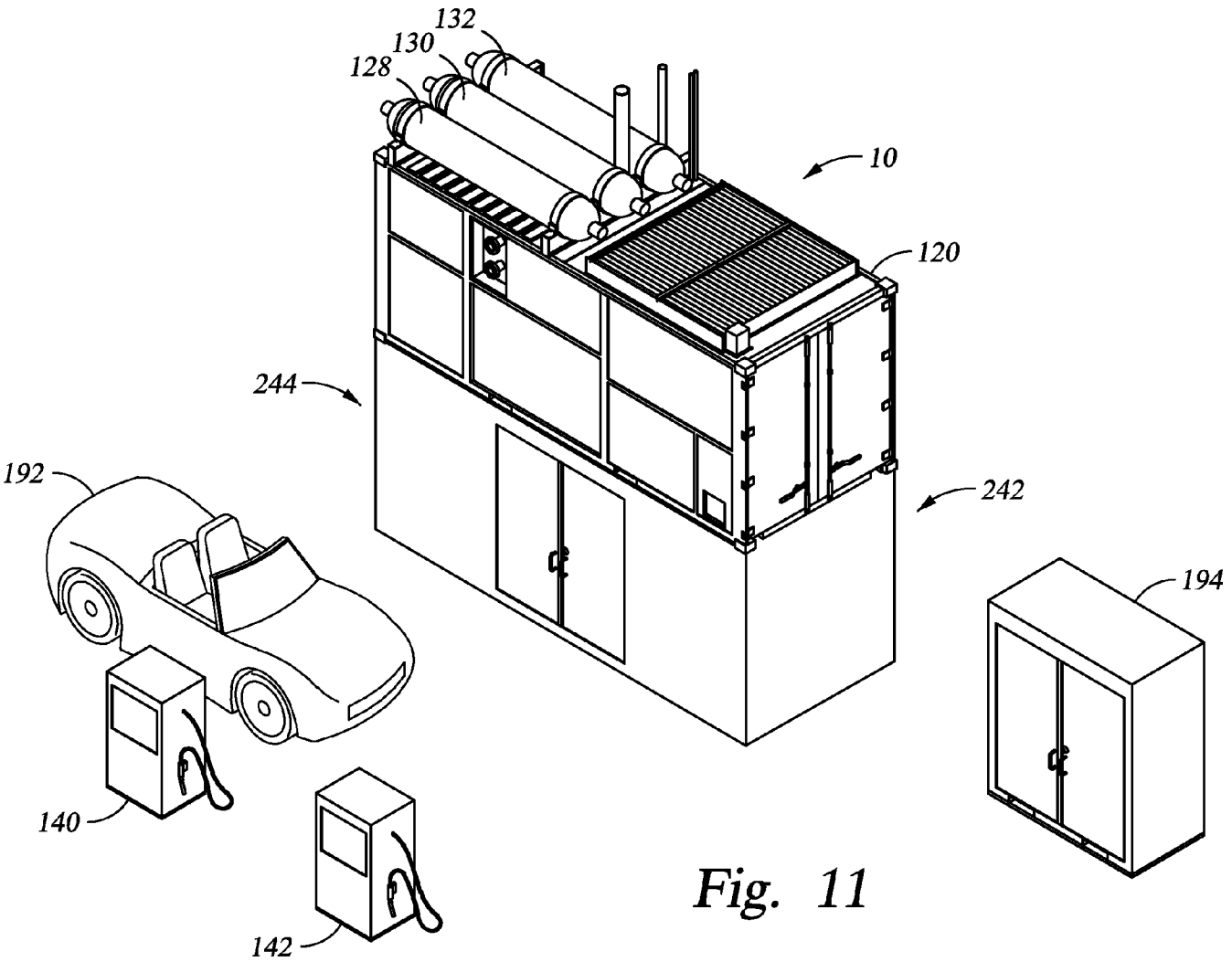
FIG. 11 is a perspective view of an alternate embodiment of the compressed hydrocarbon gas system of FIG. 9 and in accordance with an embodiment of the invention.

FIG. 11 is a perspective example of the embodiment of FIG. 9 wherein the CG system 10 and container 120 are mounted on top of, or supported over, an existing structure 242. In this example, the structure 242 can be a commercial business, such as an existing refueling station where traditional fuels of gasoline and/or diesel are sold on the location having the CG system 10. Optionally, a support frame 244 can be provided for mounting the CG system 10. Thus, in this example, the location of the CG system 10 can provide sales of compressed gas via dispensers 140, 142 and can also provide sales of traditional gasoline and diesel distillate fuels. Another advantage of providing the CG system 10 in container 120 is that an existing fueling station can dispense compressed gas without consuming additional space except for the dispensers. The ability to occupy unused space (i.e. the top of an existing structure) for compressing gas can be essential when a fueling station has restricted space, such as in an urban area. Moreover, disposing the CG system 10, with its storage tanks 128, 130, 132 at elevation increases security of the system 10.

Figure 12:
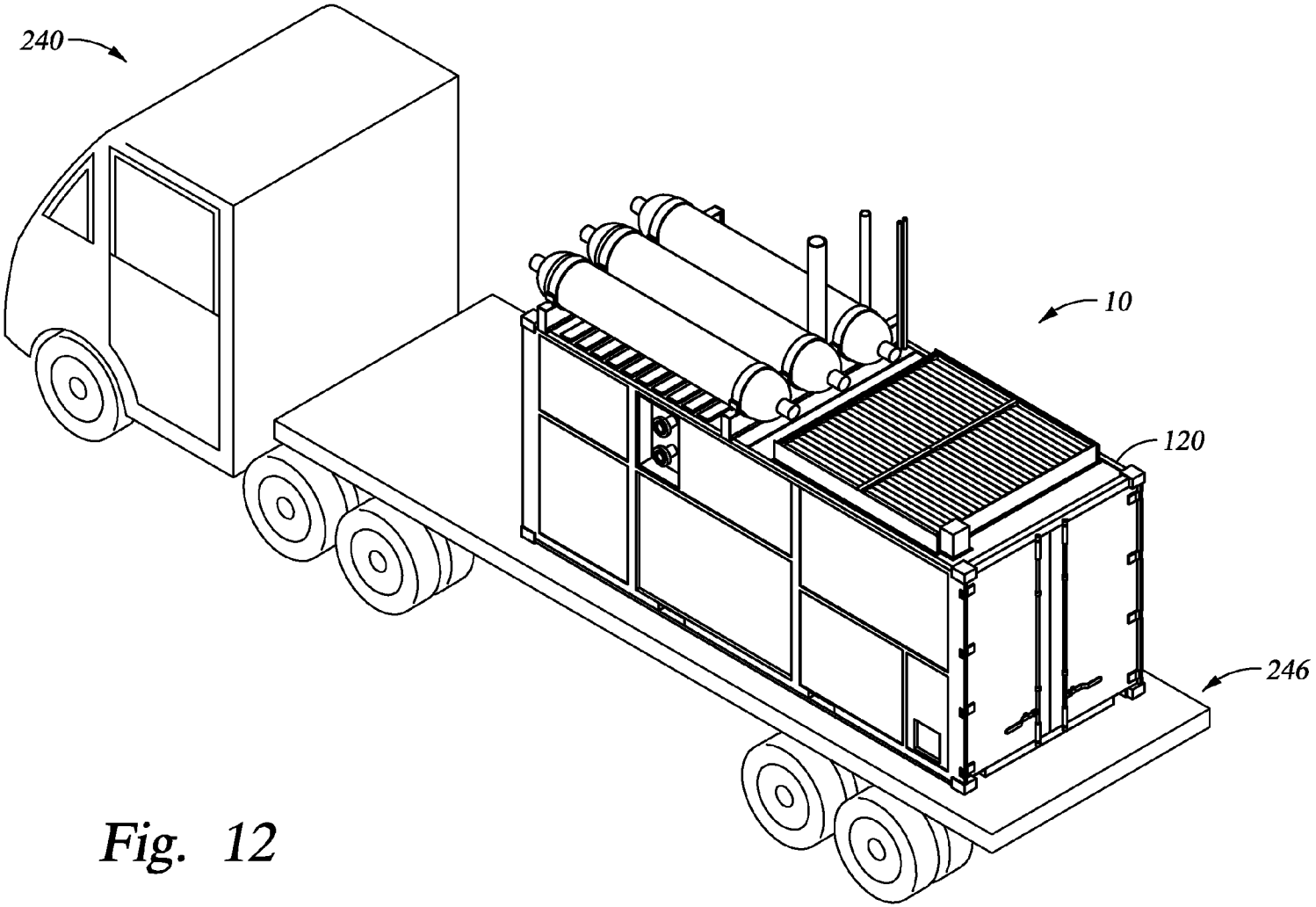
FIG. 12 is a perspective view of an example of the compressed hydrocarbon gas system of FIG. 1 set on a trailer in accordance with an embodiment of the invention.

Referring now to FIG. 12, shown in a perspective view is an example of the CG system 10 in its container 120 set on a wheeled trailer 238. In this embodiment, the CG system 10 can be transported to a location of use, and remain on the trailer 246 while compressing gas and delivering the compressed gas. Further in this example, the dispenser (not shown) can be integral within the housing 120 and the dispenser nozzle mounted on a sidewall of the container 120. Also shown in FIG. 12 is a tractor trailer rig 248 for hauling the trailer 246 and CG system 10. However, examples exist wherein motive powering for moving the CG system 10 is integral with the trailer 246 so a rig 248 would be unnecessary.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of supplying compressed hydrocarbon gas from a standardized shipping container having an interior and a roof, comprising:

disposing a compressor package in the interior of the container to define a modular compression system;

mounting at least one storage tank on the roof of the container;

mounting a louvered vent in an opening on the roof of the container, wherein the louvered vent is directly adjacent to the tank and positioned such that the tank does not substantially overlap the louvered vent;

transporting the modular compression system to a location having a supply of hydrocarbon gas;

compressing hydrocarbon gas from the supply of hydrocarbon gas to form compressed hydrocarbon gas; and delivering the compressed hydrocarbon gas to the storage tank for subsequent dispensing to a vehicle.

2. The method of claim 1, wherein the roof has a first portion extending from a first end of the container toward a second end of the container and a second portion extending from a junction with the first portion to the second end of the container, each of the portions extending across a full width of the container; wherein mounting the storage tank on the roof comprises mounting the storage tank entirely on the first portion of the roof; and wherein:

mounting the louvered vent in an opening on the roof comprises mounting the louvered vent entirely in the second portion of the roof.

3. The method of claim 1, further comprising panels, doors, and vents that are selectively removable from the shipping container or openable to provide access to the compressor package.

4. The method of claim 1, wherein the compressor package further comprises a fan cooler disposed in the shipping container and that is in fluid communication with the louvered vent, wherein the louvered vent comprises a series of louvers that are moveable for selectively opening and closing the louvered vent.

5. The method of claim 1, wherein mounting at least one storage tank on the roof comprises mounting three storage tanks on the roof of the container.

6. The method of claim 1, wherein the supply of hydrocarbon gas comprises a natural gas utility line having hydrocarbon gas at a pressure that ranges from around 0.5 psig to around 200 psig, and wherein the compressed hydrocarbon gas is at a pressure of at least around 3000 psig.

7. The method of claim 1, wherein a controller for controlling the compressor package is provided in the shipping container and is accessible by a door hingedly mounted on the shipping container.

8. The method of claim 1, wherein the shipping container is an International Standards Organization (ISO) shipping container.

9. The method of claim 1, wherein:

mounting at least one storage tank on the roof comprises providing three storage tanks, each of the storage tanks having a cylindrical side wall with an axis, and mounting the storage tanks side-by-side on a first portion of the roof with the axes parallel with each other; and wherein the method further comprises placing a fan cooler in the shipping container that is in fluid communication with the louvered vent in the opening, the opening being in a second portion of the roof adjacent the first portion of the roof, wherein the louvered vent comprises a series of louvers that are moveable for selectively opening and closing the louvered vent.

10. A method of generating a supply of compressed natural gas using an International Standards Organization (ISO) shipping container having an interior, a roof and a length greater than a width, the method comprising:

a. installing a natural gas compressor package in the interior of the ISO shipping container to define a modular compressed natural gas unit;

b. mounting a plurality of storage tanks on the roof in a first portion of the roof;

c. providing a louvered vent in an opening of a second portion of the roof directly adjacent the storage tanks and positioned such that the tanks do not substantially overlap the louvered vent, the louvered vent comprising selectively movable louvers to open and close the vent, and moving the louvers in a direction to open the vent when the compressor package is operating, and moving the louvers in an opposite direction to close the vent when the compressor package is at rest;

d. directing a supply of natural gas to the compressor package; and e. compressing the natural gas in the compressor package to generate compressed gas and delivering the compressed natural gas to the storage tanks on the roof for subsequent dispensing to vehicles.

11. The method of claim 10, further comprising providing a dryer in the ISO shipping container, attaching an end of a regeneration line to the dryer and locating another end of the regeneration line outside of the ISO shipping container, flowing the natural gas through the dryer, removing the dryer from communication with the natural gas, and removing moisture from the dryer by flowing a regeneration gas through the dryer.

12. The method of claim 10, further comprising providing a control unit in the ISO shipping container, wherein the control unit comprises a touch screen for communication with the compressor package and for manually controlling the compressor package and a controller for automated control of the compressor package.

13. The method of claim 10, wherein:

mounting a plurality of storage tanks on the roof comprises providing each of the storage tanks with a cylindrical portion having a longitudinal axis:

mounting two spaced apart supports on the roof, each extending across the roof of the container perpendicular to the length of the container, each of the supports having a plurality of semi-cylindrical upward facing recesses;

placing each of the storage tanks in one of the recesses of both of the supports with the axes parallel with each other and parallel with the length of the container; and strapping the storage tanks to the supports.

14. The method of claim 10, wherein the modular compressed natural gas unit is mounted on top of a structure that houses a business.

15. A system for compressing and dispensing compressed natural gas comprising:

a container having an interior and a roof;

a compressor package disposed in the interior of the container to define a modular compression system, and that comprises an inlet line connected to a supply of natural gas and an outlet;

at least one storage tank mounted on the roof of the container in selective communication with the outlet for storing the natural gas compressed by the compressor package;

the storage tank being in selective communication with a dispenser for dispensing the compressed natural gas from the storage tank into a vessel of a vehicle; and mounting a louvered vent in an opening in the roof, wherein the louvered vent is directly adjacent to the tank and positioned such that the tank does not overlap the louvered vent.

16. The system of claim 15, wherein the container has a length greater than a width, and the at least one storage tank comprises a plurality of elongated storage tanks mounted side-by-side parallel with the length of the container.

17. The system of claim 15, wherein:

the container has a length greater than a width;

the roof has a first portion extending from a first end of the container along the length of the container;

the roof has a second portion extending from a junction with the first portion along the length of the container to a second end of the container;

the at least one storage tank is located entirely in the first portion of the roof; and the louvered vent is located entirely in the second portion of the roof for venting the interior of the container.

18. The system of claim 15, further comprising selectively removable vents mounted in openings in a sidewall of the container and strategically located so that substantially all components in the compressor package are accessible when all components are installed in the container.

19. The system of claim 17, wherein the louvered vent comprises elongated planar louvers mounted in parallel and rotatable from a generally horizontal orientation to define a barrier between the interior and an upper side of the roof of the container, and pivotable to a generally vertical orientation to provide communication between the interior and the upper side of the roof of the container.

20. A system for compressing hydrocarbon gas comprising:

a standardized shipping container having sidewalls, a first end, a second end, a length extending from the first end to the second end that is greater than a width between the sidewalls, and a roof;

the roof having a first portion extending from the first end partway toward the second end, the roof having a second portion extending from a junction with the first portion to the second end;

a compressor package in the container to define a modular compression system, and which comprises a compressor, a compressor driver, piping, and valves in the piping that are strategically oriented and located in the shipping container, so that locations of maintenance of the compressor, driver, piping, and valves are accessible through selectively opened access elements in sidewalls of the container;

an inlet line connected to the compressor package that is selectively connected to a supply of hydrocarbon gas;

a plurality of gas storage tanks in selectively communication with an outlet of the compressor package for storing hydrocarbon gas compressed by the compressor package, each of the tanks having a cylindrical portion with an axis, the tanks being mounted entirely on the first portion of the roof with the axes parallel with each other and extending from the first end toward the second end of the container;

a fan cooler in the shipping container that is in fluid communication with a louvered vent in an opening in the roof of the container in the second portion of the roof, wherein the louvered vent is directly adjacent to the tanks and positioned such that the tanks do not substantially overlap the louvered vent, and wherein the louvered vent comprises a series of louvers that are moveable for selectively opening and closing the louvered vent; and an exit line connected to the storage tanks for transporting hydrocarbon gas from the storage tanks to a dispenser for dispensing into a motor vehicle.

21. The system of claim 20, further comprising:

a pair of supports mounted on the roof, one of the supports being adjacent the first end of the container and the other being adjacent a junction of the first portion of the roof with the second portion of the roof, each of the supports having a plurality of semi-circular upward facing recesses;

each of the storage tanks being received in one of the recesses of both of the supports; and straps securing the storage tanks to the supports.

* * * * *